US005950574A

United States Patent [19]

Matsuda et al.

[11] Patent Number: 5,950,574

[45] Date of Patent: Sep. 14, 1999

[54] BOILER

[75] Inventors: Junichiro Matsuda; Fumio Koda, both of Kure; Tetsuo Mimura, Hiroshima; Takayo Kawase, Kure; Shigeki Morita, Hiroshima, all of Japan

[73] Assignee: Babcock-Hitachi Kabushiki Kaisha, Tokyo, Japan

[21] Appl. No.: 09/125,283

[22] PCT Filed: Dec. 16, 1997

[86] PCT No.: PCT/JP97/04625

§ 371 Date: Aug. 14, 1998

§ 102(e) Date: Aug. 14, 1998

[87] PCT Pub. No.: WO98/27385

PCT Pub. Date: Jun. 25, 1998

[30] Foreign Application Priority Data

Dec. 17, 1996 [JP] Japan ..... 8-337020

[51] Int. Cl.[6] ..... F22G 5/04

[52] U.S. Cl. ..... 122/460; 122/479.1

[58] Field of Search ..... 122/406.1, 459, 122/460, 478, 479.1

[56] References Cited

U.S. PATENT DOCUMENTS 2,980,082 4/1961 Firl ..... 122/479.1

4,198,930 4/1980 Pratt et al. ..... 122/478

4,442,800 4/1984 Seifert et al. ..... 122/478

*Primary Examiner*—Teresa Walberg

*Assistant Examiner*—Gregory A. Wilson

*Attorney, Agent, or Firm*—Antonelli, Terry, Stout & Kraus, LLP

[57] ABSTRACT

Only suspension type superheaters (52) and (53) are disposed in an outlet of a furnace. These superheaters have heat transfer areas which are so dimensioned that an exhaust gas temperature at downstream of the superheaters is 1000° C. to 1100° C. when the boiler is under a maximum load. An exhaust gas passage downstream of the superheaters (52) and (53) is divided into sub passages along a flow of an exhaust gas, and a damper is disposed in an outlet of each of the sub passages for adjusting a flow rate of the exhaust gas flowing through the respective sub passages. A traverse type reheater (41) is disposed in the sub passage. Since a difference between a temperature (1000° C. to 1100° C.) of the exhaust gas flowing around the reheater (41) and a temperature of steam flowing through the reheater (41) is large, heat exchange can be performed with a high efficiency even through a small heat transfer area. Accordingly, this configuration makes it possible to prevent a heat transfer area of the reheater (41), or overall dimensions of a boiler from being increased.

3 Claims, 2 Drawing Sheets

BOILER

TECHNICAL FIELD

The present invention relates to a boiler, and more specifically a boiler having a reheater for an electric power industries, and having a medium or a large capacity, a maximum continuous evaporation rate of which boiler is at least 500 t/hr.

In a power generation plant, steam which has done a work in a high pressure turbine to be in relative lower pressure is extracted out therefrom, reheated and supplied to a medium pressure turbine and a low pressure turbine to do a work therein, thereby enhancing a thermal efficiency of the turbines as a whole. The above-mentioned boilers are used, for example, in such a power generation plant.

In such a boiler, superheaters for generating steam of relative high temperature and relative high pressure and reheaters for generating steam of relative high temperature and relative low pressure are disposed in an upstream side exhaust gas passage through which exhaust gas generated due to combustion of fuel in a furnace passes. Particularly in the boiler having a medium or a large capacity, a maximum continuous evaporation rate of which boiler is at least 500t/hr, and which boiler is used in a power generation plant, the reheaters are disposed, like the superheaters, in the upstream side exhaust gas passage of relative high temperature so as to obtain high temperature steam.

There is a boiler in which a down stream side exhaust gas passage is divided into two or more sub passages along a flow of the exhaust gas, at a down stream portion of each of which sub passages a damper is provided for adjusting a flow rate of the exhaust gas passing through the respective sub passages. JP-A-59-60103 and JP-A-58-217104 disclose structures in which reheaters are disposed in one or two sub passages and superheaters are disposed in the remaining sub passages, respectively. JP-A-62-33204 discloses a structure wherein a superheater and an economizer are disposed in one of the sub passages, and an evaporator and an economizer are disposed in the other one.

In the upstream side exhaust gas passage communicated with an outlet of the furnace, through which exhaust gas of relative high temperature passes, a suspension type high-temperature side superheater is disposed, and a suspension type high-temperature side reheater is also disposed downstream of the high-temperature side superheater. Heat transfer is carried out more effectively in the upstream side exhaust gas passage, as compared with in downstream side exhaust gas passage. This is because a temperature of the exhaust gas in the upstream side exhaust gas passage is higher than that in the downstream side exhaust gas passage and there is a heating due to radiation from a combustion flame in the furnace. Since the high-temperature side superheater is disposed in the upstream side exhaust gas passage where an effective heat transfer is carried out, it becomes possible to prevent an area of heat transfer part of the superheater from increasing, namely it is possible to reduce dimensions of the superheaters as a whole as well as to obtain a higher heat transfer efficiency. As a result, it is possible to prevent increase in dimensions and a weight of the boiler as a whole.

It is also possible to reduce the dimension of the reheater as a whole by means of locating the high-temperature side reheater in the upstream side exhaust gas passage, through which the exhaust gas of relative high temperature passes (or in which a heat transfer rate is high), so that the high-temperature side reheater follows the high-temperature side superheater, as like the high-temperature side superheater does. However, since the dimensions of the high-temperature side superheater and the high-temperature side reheater disposed in the upstream side exhaust gas passage are reduced, it is hard to obtain heat transfer areas required to the high-temperature side superheater and the high-temperature side reheater as a whole by means of only these reduced high-temperature side superheater and the high-temperature side reheater. Therefore it is needed to provide additional superheater and reheater. These are traverse type low-temperature side superheater and low-temperature side reheater, respectively, which are disposed in the respective sub passages of the downstream side exhaust gas passage at downstream of the suspension type high-temperature side superheater and high-temperature side reheater. In view of thermal efficiency, the suspension type high-temperature side superheater is disposed upper-stream side in the upstream side exhaust gas passage in preference to others. Therefore, the high-temperature side reheater must be disposed in a limited space in the upstream side exhaust gas passage, downstream side of such high-temperature side superheater. This means that it is impossible to provide the high-temperature side reheater with sufficient dimension. Since the high-temperature side reheater may not be so large enough, it is needed to additionally dispose a transverse type low-temperature side reheater in the sub passage of the downstream side exhaust gas passage, which would undertake a major part of heat transfer areas required for the reheaters as a whole. The steam in the low-temperature side superheater and the low-temperature side reheater is heated due to convection and then supplied to outside the boiler, for example, a power generation turbine through the high-temperature side superheater and the high-temperature side reheater. A damper is disposed in each of the sub passages in which the low-temperature side superheater and the low-temperature side reheater are provided, respectively so as to adjust a flow rate of the exhaust gas which is to be brought into contact with the low-temperature side superheater or the low-temperature side reheater. The steam in the low-temperature side superheater and the low-temperature side reheater is heated up to a predetermined temperature by means of controlling the dampers and the supplied to the high-temperature side superheater and the high-temperature side reheater, respectively.

The temperature control of steam in the low-temperature side superheater and the low-temperature side reheater is carried out by means of adjusting the dampers, as described above. However, since the high-temperature side superheater and the high-temperature side reheater are disposed upperstream of the sub passages, the temperature control of steam by means of the dampers is not carried out in these high-temperature side heat transfer apparatus. Accordingly, the steam temperature control in the low-temperature side superheater and the low-temperature side reheater does not act directly on a steam temperature in an inlet of the turbine. In other words, there is a time delay, or a dead time between a change of a steam temperature in the outlet of the low-temperature side superheater and that in the outlet of the high-temperature side superheater, and between a change of steam temperature in the outlet of the low-temperature side reheater and that in the high-temperature side reheater, or in the inlet of the turbine.

In case that a control gain of the damper is enhanced for shortening the dead time, the boiler system becomes unstable or diverges, thereby lowering a controllability. In particularly, in respect of the reheater, since the reheater which would undertake a major part of heat transfer areas required for the reheaters as a whole is disposed within the sub passage, the controllability deteriorates.

Therefore, the present invention has a primary object to provide a boiler which has an improved steam temperature controllability without increasing a heat transfer area of each of the reheaters uselessly.

Disclosure of the Invention

To this end, according to the present invention, there is provided with a boiler which comprises a furnace, an upstream side exhaust gas passage communicated with an outlet of the furnace through a one end thereof, a downstream side exhaust gas passage communicated with the other end of the upstream side exhaust gas passage and divided into sub passages along a flow of an exhaust gas, suspension type heat transfer apparatus disposed within the upstream side exhaust gas passage, all of which heat transfer apparatus are superheaters and heat transfer surfaces of which heat transfer apparatus dimensioned so that an exhaust gas temperature in an inlet of the downstream side exhaust gas passage becomes 1000° C. to 1100° C. when the boiler is under a maximum load, traverse type heat transfer apparatus disposed within the downstream side exhaust gas passage, which includes a reheater, and means disposed in an outlet of each of the sub passages for controlling a flow rate of the exhaust gas passing through the respective sub passages.

According to the present invention, since an exhaust gas temperature in the inlet of the downstream side exhaust gas passage is higher as compared with that in the conventional boiler, a temperature difference between the steam passing in the reheater and the exhaust gas becomes large, thereby making it unnecessary to increase heat transfer surfaces of the reheaters.

Further, since all the reheaters are disposed in the sub passage of the downstream side exhaust gas passage, it is possible to reduce the dead time. Furthermore, all the reheaters becomes the controlled object, the steam temperature control with a higher accuracy in the outlet of the reheater can be carried out, namely the steam temperature control with a higher accuracy in the inlet of the turbine can be carried out.

Now, a preferred embodiment of the present invention will be described below with reference to the accompanying drawings.

BEST MODE FOR CARRYING OUT OF THE INVENTION

Figure 1:
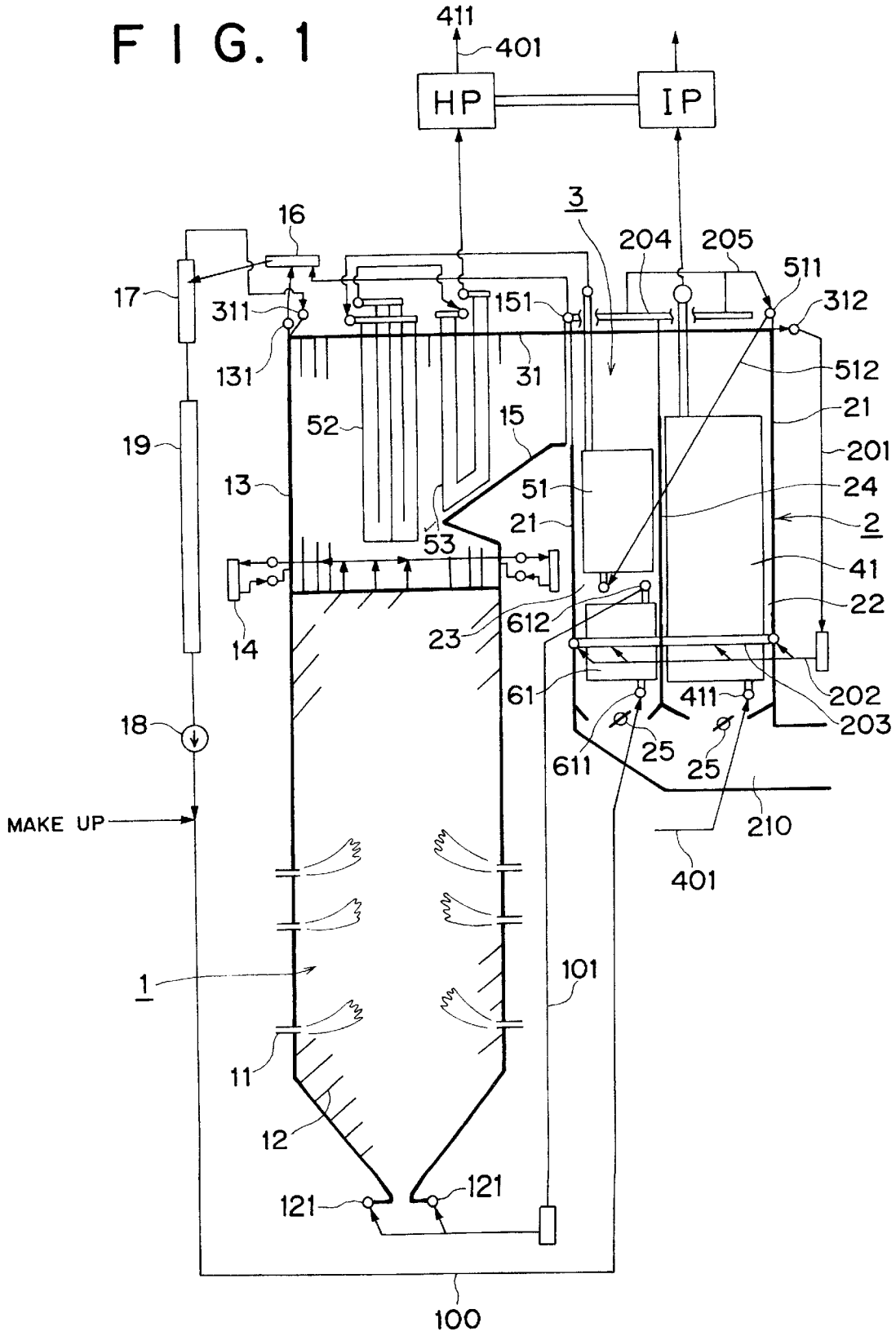
FIG. 1 is a side view illustrating the boiler according to the present invention.

In FIG. 1, a boiler comprises a furnace 1, a downstream side exhaust gas passage 2 and a upstream side exhaust gas passage 3 communicating an upper section of the furnace 1 with the downstream side exhaust gas passage 2. The boiler is, for example, a coal-fired boiler.

A high temperature combustion gas from a plurality of burners 11 disposed in a lower section of the furnace 1 passes upward in the furnace 1. The combustion gas passes through the upstream side exhaust gas passage 3 and the downstream side exhaust gas passage 2 and is exhausted out of the boiler as an exhaust gas of low temperature through an outlet 210. A lower water-cooled wall 12, an upper water-cooled wall 13 and a nose wall 15 are provided in the furnace 1. The lower water-cooled wall 12 consists of a plurality of pipes each of which extends, in the furnace, spirally upward from a lower section of the furnace. The upper water-cooled wall 13 also consists of a plurality of pipes each of which extends straight vertically in the furnace. The nose wall 15 also consists of a plurality of pipes.

The downstream side exhaust gas passage 2 is defined by a wall 21 which consists of a plurality of pipes. The downstream side exhaust gas passage 2 is divided into two sub passages 22 and 23 by a partition wall 24 which extends along a flow of the exhaust gas. A damper 25 which serves to control a flow rate of the combustion gas passing through the respective sub passages is disposed in an outlet of each of the sub passages. The partition wall 24 also has a plurality of pipes.

A traverse type reheater 41 is disposed in one 22 of the sub passages of the downstream side exhaust gas passage 2, whereas a traverse type primary superheater 51 and a traverse type economizer 61 are disposed in series along the flow of the combustion gas in the other sub passage 23. An evaporator may be disposed in the sub passage 23 if necessary.

The upstream side exhaust gas passage 3 is defined by a ceiling wall 31 which consists of a plurality of pipes, and side walls. A suspension type secondary superheater 52 and a suspension type tertiary superheater 53 are disposed in series along the flow of the combustion gas in the upstream side exhaust gas passage 3. These superheaters 52 and 53 have a total heat transfer area which is set so that a combustion gas temperature in an inlet of the upstream side exhaust gas passage 2 becomes 1000° C. to 1100° C. when the boiler is under a maximum load.

The term "traverse type" used in this specification means a condition where a heat transfer pipe of the heat transfer apparatus such as a reheater extends substantially horizontally against a vertical gas flow. Further, the term "suspension type" means a condition where a heat transfer pipe of the heat transfer apparatus such as a superheater extends substantially vertically against a horizontal gas flow, and an inlet and an outlet are provided in a vertical upper portion.

Now, description will be made of a water supply system for the boiler.

Water is supplied to the economizer 61 disposed in the sub passage 23 through a water supply pipe 100. The water flows from an inlet header 611 to an outlet header 612 of the economizer 61 and absorbs heat from the combustion gas (exhaust gas). The water thus heated is distributed from the outlet header 612 to a plurality of lower headers 121 of the lower water-cooled wall 12 of the furnace 1 through a falling pipe 101.

The water absorbs heat in the interior of the furnace and goes up from the lower headers 121 through the respective pipes of the lower water-cooled wall 12. The water is heated up close to a saturation temperature thereof. Water temperatures in the pipes are unbalanced in an outlet of the lower water-cooled wall since different pipes absorb different amounts of heat. The high-temperature water flows from the respective pipes of the lower water-cooled wall 12 into an intermediate mixing header 14 for being uniformed in the temperature thereof.

The high temperature water from the mixing header 14 further absorbs the heat in the interior of the furnace, and goes up through pipes of the upper water-cooled wall 13 and the nose wall 15 to become high-temperature water in a liquid phase and steam in a vapor phase. A mixture of the high-temperature water and the steam from the pipes of the upper water-cooled wall 13 and the nose wall 15 passes through a water-cooled wall header 131 and a nose wall header 151 respectively, and passes into an upper mixing header 16 for being uniformed in the temperature thereof, and then flows into a steam separator 17.

In the steam separator 17, the mixture is separated into high-temperature water which is to be supplied by a circulating pump 18 to a feeder pipe 100 through a drain tank 19, and steam which is to flow into an inlet header 311 of the pipes of the ceiling wall 31. During a once-through operation of the boiler, steam which composes all fluid flowing into the steam separator 17 is supplied to an inlet header 311.

The steam from the inlet header 311 passes through the pipes of the ceiling wall 31 towards an outlet header 312 to absorb heat in the interior of the furnace and becomes superheated steam. The superheated steam flows from the outlet distributing header 312 through a falling pipe 201 and a communicating pipe 202 into an inlet distributing header 203 which is communicated with the pipes of the wall 21 and the partition wall 24 of the downstream side exhaust gas passage 2. The superheated steam absorbs the heat in the interior of the furnace and goes up through the pipes of the wall 21 and the partition wall 24 of the downstream side exhaust gas passage 2. The superheated steam flows directly or through an outlet distributing header 204 and a communicating pipe 205 into an outlet header 511.

The superheated steam further flows from the outlet header 511 through a communicating pipe 512 into the primary superheater 51. Successively, the superheated steam is heated to a predetermined superheated steam temperature while flowing through the secondary superheater 52 and the tertiary superheater 53, and supplied to a high pressure turbine HP.

Steam which has done work in the high pressure turbine HP flows into an inlet header 411 of the reheater 41 through a steam pipe 401. In the reheater 41, the steam absorbs heat from the exhaust gas in the sub passage 22 and is heated to the predetermined reheated steam temperature, and then is supplied to an intermediate pressure turbine IP. It is possible to control an amount of heat to be absorbed by the steam in the reheater 41, or a reheated steam temperature, by adjusting an amount of the exhaust gas which is to flow through the sub passages with the dampers 25.

Figure 2:
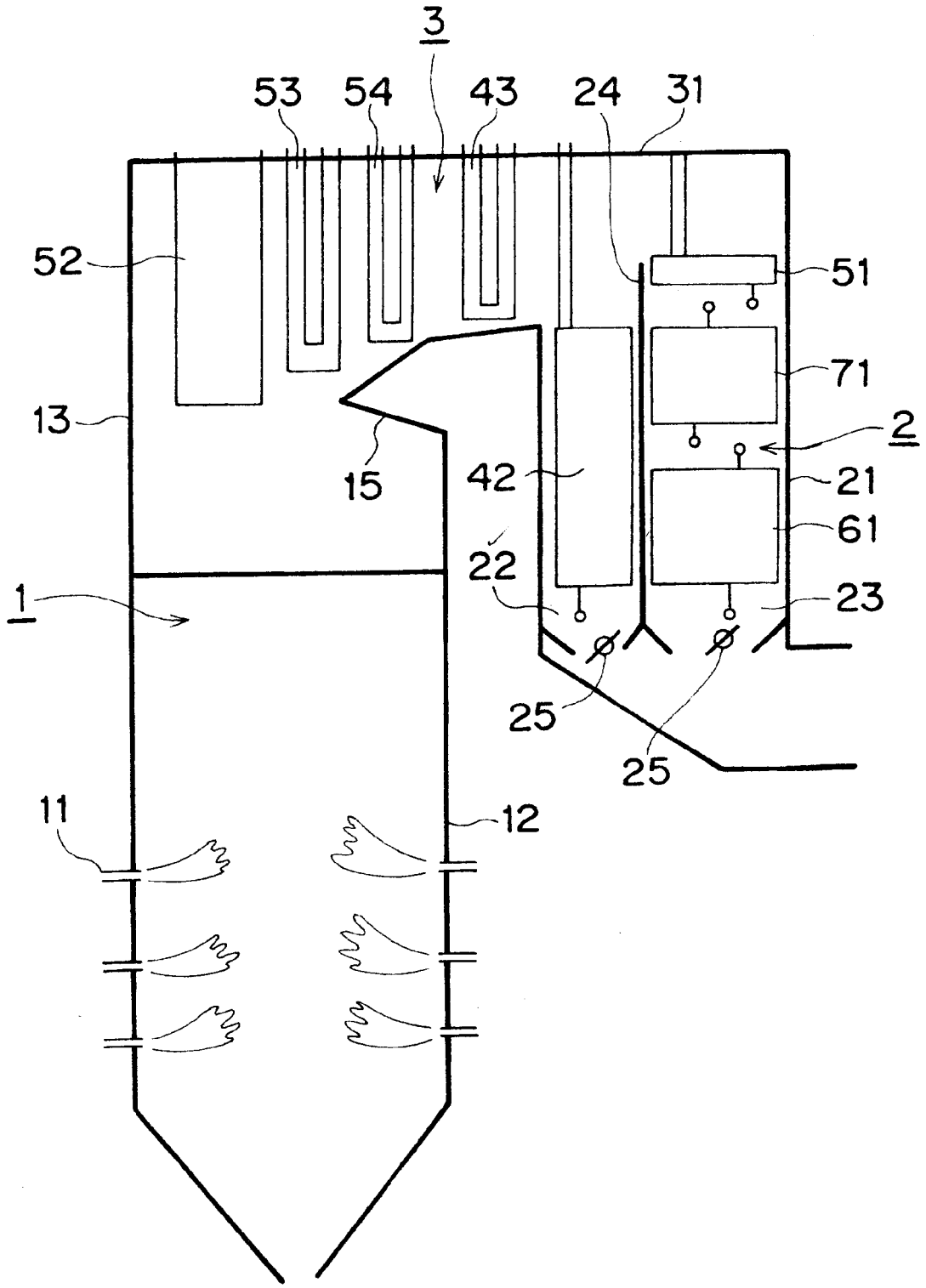
FIG. 2 is a side view illustrating a conventional boiler.

In a conventional boiler shown in FIG. 2 (the components which are the same as or similar to those shown in FIG. 1 are represented by the same reference numerals with no particular description), a second reheater 43 is disposed in the upstream side exhaust gas passage 3 in addition to the secondary superheater 52 through the forth superheater 54. In view of thermal efficiency, the superheaters 52–54 are disposed in the upstream side exhaust gas passage 3 in preference to others, and then a space for the second reheater 43 is not so large. Therefore, it is hard for the second reheater 43 to cover a heat transfer area required for the reheaters as a whole. Accordingly, as described later, it is necessary to dispose an additional reheater 42 so as to complement a required heat transfer area. The downstream side exhaust gas passage 2 is divided into two sub passages 22 and 23 by means of a partition wall 24 extending along a flow of the exhaust gas. A damper 25 is provided at an outlet of each of the sub passages. The reheater 42 is disposed in one 22 of the sub passages, while a primary superheater 51, an evaporator 71 and an economizer 61 are disposed in series in the other sub passage 23. The temperature of the combustion gas (exhaust gas) in the inlet of the downstream side exhaust gas passage 2 is about 800° C. when the boiler is under a maximum load. Since a temperature difference between the exhaust gas (800° C.) and a desired reheated steam (normally 560° C. to 600° C.) is small, it is necessary to enlarge a heat transfer area of the second reheater 43. Accordingly, the second reheater 43 has large dimensions, thereby making it impossible to prevent the boiler as a whole to be enlarged.

To the contrary, in the embodiment shown in FIG. 1, the temperature of the combustion gas (exhaust gas) in the inlet of the downstream side exhaust gas passage 2 is about 1000° C. when the boiler is under a maximum load. Since a temperature difference between the exhaust gas (1000° C.) and a desired reheated steam (560° C. to 600° C.) is large, the reheater 41 may have a smaller heat transfer area, thereby making it possible to prevent the boiler as a whole to be enlarged. In order that the temperature of the combustion gas (exhaust gas) in the inlet of the downstream side exhaust gas passage 2 is about 1000° C. when the boiler is under a maximum load, a heat transfer area of the superheater in the upstream side exhaust gas passage is somewhat increased as compared with that in the conventional boiler (in which the superheater as well as the reheater is disposed in the upstream side exhaust gas passage). Namely, the dimensions of the superheater is somewhat increased, but such increment does not substantially contribute an enlargement of the boiler. Incidentally, in the accompanying drawings, the dimensional ratio of the reheater or the like is modified.

Further, since the single reheater 41 is used instead of the separate reheaters 42 and 43 (FIG. 2), it is further possible to make only the heat absorption of the steam in the reheater 41 a controlled object of the damper 25 control, thereby permitting enhancement of a control gain. Accordingly, the reheated steam temperature is raised. Furthermore, there is no dead time in control response.

Moreover, there is no hunting phenomenon since the flow rate control of an exhaust gas by the dampers 25 acts directly on the heat absorption by the steam in the reheater 41.

Such enhancement of controllability is effective in particular when only a reheater is disposed in one of sub passages of the downstream side exhaust gas passage, and only a superheater and an economizer are disposed in the other sub passage as in the embodiment of the present invention.

In case of a coal-fired boiler, a large amount of coal ash is generally contained in a combustion gas. The coal ash has a minimum softening temperature of approximately 1100° C. When the coal ash is softened and adheres to a heat transfer surface of a heat transfer apparatus, the coal ash is cooled and hardened. The so-called slugging which is growth of the coal ash caused by repetition of the softening and adherence lowers a heat transfer efficiency. Accordingly, it has conventionally required to remove the coal ash periodically. When the present invention is applied to a coal-fired boiler as in the embodiment, traverse type heat transfer apparatus, for example, the primary reheater 41, the primary superheater 51 and the economizer 61 make it more difficult to remove the coal ash once it adheres to the apparatus than suspension type heat transfer apparatus.

However, according to the present invention, an exhaust gas temperature upstream the traverse type heat transfer apparatus is 1000° C. to 1100° C. Since it is lower than the softening temperature of the coal, it can be possible to prevent the slugging. Further, since it is substantially higher than the desired reheated steam temperature (560° C. to 600°

C.), it is not necessary to increase the heat transfer apparatus in the downstream side exhaust gas passage, thereby preventing the whole boiler from being enlarged. As described above, the present invention is particularly efficient in a coal-fired boiler.

Industrial Applicability

The boiler according to the present invention is applicable to a power generation plant which has a large capacity.

We claim:

1. A boiler comprising:

a furnace;

an upstream side exhaust gas passage communicated at one end thereof with an outlet of said furnace;

a downstream side exhaust gas passage communicated with the other end of said upstream side exhaust gas passage and divided into sub passages along a flow of an exhaust gas;

suspension type heat transfer apparatus disposed within said upstream side exhaust gas passage, all of which heat transfer apparatus are superheaters, and heat transfer surfaces of said heat transfer apparatus dimensioned so that an exhaust gas temperature in an inlet of said downstream side exhaust gas passage becomes 1000° C. to 1100° C. when said boiler is under a maximum load;

traverse type heat transfer apparatus disposed within said downstream side exhaust gas passage; and means disposed in an outlet of each of said sub passages for controlling a flow rate of the exhaust gas passing through the respective sub passages.

2. A boiler according to claim 1 characterized in that said traverse type heat transfer apparatus include reheaters.

3. A boiler according to claim 1 or 2 characterized in that a traverse type reheater is disposed in one of said sub passages, and at least a superheater and an economizer among said superheater, an evaporator and said economizer are disposed in the other sub passage.

* * * * *